US011462817B2

(12) United States Patent
Qu et al.

(10) Patent No.: US 11,462,817 B2
(45) Date of Patent: Oct. 4, 2022

(54) PACKAGING STRUCTURE

(71) Applicant: Huawei Technologies Co., Ltd., Shenzhen (CN)

(72) Inventors: Heng Qu, Shanghai (CN); Ming Chang, Shanghai (CN); Hailin Dong, Shanghai (CN); Xinhong Li, Shenzhen (CN); Liangsheng Liu, Shenzhen (CN); Hongcheng Yin, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 17/079,997

(22) Filed: Oct. 26, 2020

(65) Prior Publication Data

US 2021/0043998 A1 Feb. 11, 2021

Related U.S. Application Data

(63) Continuation of application No. PCT/CN2018/115459, filed on Nov. 14, 2018.

(30) Foreign Application Priority Data

Apr. 25, 2018 (CN) ..... 201810378310.5

(51) Int. Cl.
*H01Q 1/22* (2006.01)
*H01Q 1/36* (2006.01)
*H01Q 13/10* (2006.01)

(52) U.S. Cl.
CPC ..... *H01Q 1/2283* (2013.01); *H01Q 1/36* (2013.01); *H01Q 13/10* (2013.01)

(58) Field of Classification Search
CPC ..... H01Q 1/2283; H01Q 1/36; H01Q 13/10; H01Q 9/04; H01Q 9/0407; H01Q 9/0414; H01Q 9/0457
See application file for complete search history.

(56) References Cited

U.S. PATENT DOCUMENTS 3,665,480 A 5/1972 Fassett
5,005,019 A * 4/1991 Zaghloul ..... H01Q 9/0414 166/270.1

(Continued)

FOREIGN PATENT DOCUMENTS

CN 1411620 A 4/2003
CN 101083359 A 12/2007

(Continued)

*Primary Examiner* — Jason Crawford
(74) *Attorney, Agent, or Firm* — Conley Rose, P.C.

(57) ABSTRACT

A packaging structure, where the packaging structure includes: a first radiation plate, a second radiation plate, and a feeding part, where the second radiation plate is disposed below the first radiation plate, where a slot is disposed on the second radiation plate, where the slot is in a ring shape, where the feeding part is disposed below the second radiation plate, and where the feeding part includes a first feeding stub and a second feeding stub that are disposed independently of each other. Additionally, the first feeding stub and the second feeding stub are perpendicular to each other and disposed on a substrate below the slot, and the first feeding stub and the second feeding stub feed the first radiation plate using the slot.

20 Claims, 11 Drawing Sheets

(56) References Cited

U.S. PATENT DOCUMENTS 5,055,852 A * 10/1991 Dusseux ..... H01Q 9/0414 343/846
5,465,100 A * 11/1995 Remondiere ..... H01Q 13/18 343/846
5,539,420 A * 7/1996 Dusseux ..... H01Q 9/0414 343/769
6,091,373 A * 7/2000 Raguenet ..... H01Q 9/0435 343/778
6,445,354 B1 * 9/2002 Kunysz ..... H01P 1/2005 343/895
7,091,907 B2 * 8/2006 Brachat ..... H01Q 1/38 343/846
7,106,264 B2 * 9/2006 Lee ..... H01Q 21/0075 343/767
10,454,173 B2 * 10/2019 Taachouche ..... H01Q 9/0464
2001/0015705 A1 8/2001 Scordilis
2005/0052321 A1 * 3/2005 Lee ..... H01Q 1/38 343/700 MS
2007/0052587 A1 * 3/2007 Cheng ..... H01Q 5/378 343/700 MS
2008/0079644 A1 * 4/2008 Cheng ..... H01Q 13/10 343/769
2009/0256752 A1 10/2009 Akkermans et al.
2011/0279190 A1 11/2011 Liu et al.
2013/0187830 A1 * 7/2013 Warnick ..... H01Q 21/065 343/893
2015/0303576 A1 * 10/2015 Latrach ..... H01Q 9/0464 343/700 MS
2016/0049723 A1 * 2/2016 Baks ..... H01Q 9/0457 343/848
2016/0056544 A1 * 2/2016 Garcia ..... H01Q 9/0407 343/725
2017/0047665 A1 * 2/2017 Yang ..... H01Q 19/005
2017/0093041 A1 * 3/2017 McMichael ..... H01Q 9/0464
2017/0338548 A1 11/2017 Xiong et al.
2019/0165466 A1 3/2019 Xu et al.
2021/0043998 A1 * 2/2021 Qu ..... H01Q 1/36

FOREIGN PATENT DOCUMENTS

CN 102007519 B 6/2012
CN 102511110 A 6/2012
CN 104662737 A 5/2015
CN 104665737 A 6/2015
CN 105449356 A 3/2016
CN 105990660 A 10/2016
CN 106450732 A 2/2017
CN 206271873 U 6/2017
CN 206532878 U 9/2017
CN 107395788 A 11/2017
CN 206685527 U 11/2017
CN 107706528 A 2/2018
JP H03254208 A 11/1991
JP 2012054917 A 3/2012

* cited by examiner

PACKAGING STRUCTURE

CROSS-REFERENCE TO RELATED APPLICATIONS

This application is a continuation of International Patent Application No. PCT/CN2018/115459, filed on Nov. 14, 2018, which claims priority to Chinese Patent Application No. 201810378310.5, filed on Apr. 25, 2018. The disclosures of the aforementioned applications are hereby incorporated by reference in their entireties.

TECHNICAL FIELD

This application relates to an antenna, and in particular, to a packaging structure.

BACKGROUND

An antenna in package is a technology in which an antenna and a chip are integrated into a package based on a packaging material and a packaging process, to implement a system-level wireless function. The antenna in package provides a good antenna solution for a system-level antenna chip because the antenna in package is well balanced between antenna performance, costs, and a volume. Therefore, it is favored by a large quantity of chip and package manufacturers, and also becomes an important antenna solution for a millimeter wave mobile communications system of the 5th generation (5G) mobile communication technology.

A packaged dual-polarized antenna array may implement a parallel dual-polarized operation manner, can form two beams to support beam scanning with high enough precision, and can maintain a transmit mode and a receive mode, thereby doubling a quantity of served users. A conventional single-polarized slot-coupled antenna has advantages of a wide bandwidth and a high gain, and includes a parasitic patch, a feeding stub, and a slot. The feeding stub is mainly used to couple and feed a plurality of types of slots. To implement packaging of a dual-polarized antenna, a single-polarized slot-coupled antenna needs to be implemented in a same-layer feeding manner. However, in this manner, feeding stubs interfere with each other, and this cannot be implemented structurally.

How to obtain a packaging structure of a wide bandwidth and a high gain is an urgent problem to be resolved.

SUMMARY

This application provides a packaging structure to implement a packaging structure of a wide bandwidth and a high gain.

According to a first aspect, this application provides a packaging structure, including: a first radiation plate, a second radiation plate, and a feeding part, where the second radiation plate is disposed below the first radiation plate, where a slot is disposed on the second radiation plate, where the slot is in a ring shape, and where the feeding part is disposed below the second radiation plate.

The feeding part includes a first feeding stub and a second feeding stub that are disposed independently of each other, where the first feeding stub and the second feeding stub are perpendicular to each other and disposed on a substrate below the slot, and where the first feeding stub and the second feeding stub feed the first radiation plate using the slot.

According to the packaging structure provided in the first aspect, by disposing the ring-shaped slot, the first radiation plate, and the second radiation plate, a bandwidth and a gain can be increased, while implementing a wide bandwidth and a high gain. Further, an operating bandwidth of an antenna is extended to a wider frequency band, and the packaging structure is applicable to a terminal operating on a wide frequency band, thereby expanding an application scope of the antenna. In addition, the slot is set to be in a ring shape, and the two feeding stubs are perpendicular to each other. In this case, electric fields corresponding to the two feeding stubs are orthogonal, and comparatively good isolation is achieved between electric fields generated by feeding by the two feeding stubs, thereby implementing comparatively high polarization isolation.

In a possible design, the first feeding stub includes a main body and a tail end, where the tail end is bent relative to the main body, the main body of the first feeding stub extends on a substrate on which the first feeding stub is located, one end of the main body of the first feeding stub is connected to a first signal line, and the other end of the main body of the first feeding stub is connected to the tail end of the first feeding stub. Additionally, the second feeding stub includes a main body and a tail end, where the tail end is bent relative to the main body, the main body of the second feeding stub extends on a substrate on which the second feeding stub is located, one end of the main body of the second feeding stub is connected to a second signal line, and the other end of the main body of the second feeding stub is connected to the tail end of the second feeding stub.

In a possible design, at least a part of the tail end of the first feeding stub is located in a projection below the slot. Additionally, at least a part of the tail end of the second feeding stub is located in a projection below the slot.

In a possible design, the first feeding stub and the second feeding stub are disposed on a same layer of substrate.

In a possible design, the slot is in a closed ring shape.

In a possible design, a shape of the slot is a circular ring, an elliptical ring, a rectangular ring, or a star ring.

In a possible design, a shape of the first radiation plate is a rectangle, a circle, or a cross.

In a possible design, the first radiation plate includes a substrate and a parasitic patch disposed on the substrate.

In a possible design, the packaging structure further includes a first ground plate that is disposed between the first signal line and the second signal line.

In a possible design, the packaging structure further includes a second ground plate that is disposed at a bottom of the feeding part.

In a possible design, the packaging structure further includes a substrate and a chip that is fixedly connected to a side of the substrate, where the chip has a plurality of feeding pins, where the plurality of feeding pins are connected to the substrate, and where the substrate includes the first radiation plate, the second radiation plate, and the feeding part.

According to a second aspect, this application provides a terminal including a radio frequency processing unit, a baseband processing unit, and a packaging structure according to the first aspect.

DESCRIPTION OF REFERENCE SIGNS IN THE ACCOMPANYING DRAWINGS

11: first radiation plate;
12: second radiation plate;
121: slot;
2: feeding part;
22: first feeding stub;
23: second feeding stub;
24: first signal line;
25: second signal line;
31: first ground plate;
32: second ground plate;
33: third ground plate; and
3: top-layer substrate.

DESCRIPTION OF EMBODIMENTS

This application provides a packaging structure and an antenna array, which can implement a wide bandwidth and a high gain, feature comparatively high polarization isolation, a simple structure, and a small size, and may be applied to a full-duplex communications system, or may be used as a multiple-input multiple-output (MIMO) antenna, or may be applied in any other possible application scenario.

To implement a packaging structure of a wide bandwidth and a high gain, this application provides a packaging structure including a first radiation plate, a second radiation plate, and a feeding part. A ring-shaped slot is disposed on the second radiation plate, the feeding part is disposed below the second radiation plate, and the feeding part includes a first feeding stub and a second feeding stub that are disposed independently of each other. The two feeding stubs feed the first radiation plate by being electromagnetically coupled to the slot. Disposing of the ring-shaped slot and the first radiation plate can increase a bandwidth and a gain, thereby implementing a wide bandwidth and a high gain. In addition, the slot is set to be in a ring shape, and the two feeding stubs are perpendicular to each other. In this case, electric fields corresponding to the two feeding stubs are orthogonal, and comparatively good isolation is achieved between electric fields generated by feeding by the two feeding stubs, thereby implementing comparatively high polarization isolation, a simple structure, and a small size. The following describes the technical solutions of this application in detail with reference to the accompanying drawings.

Figure 1:
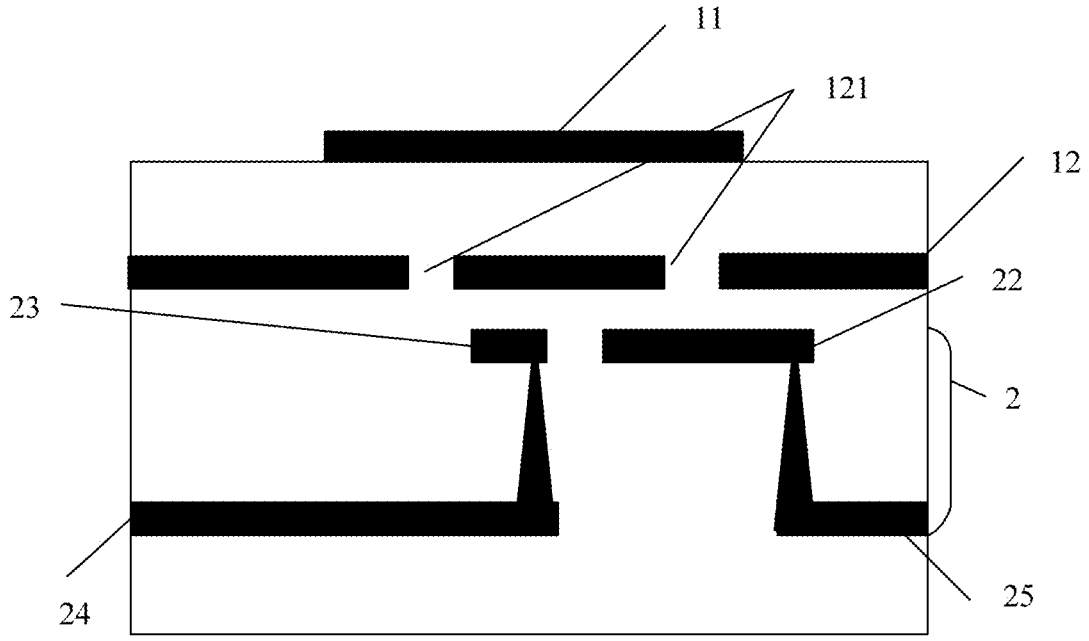
FIG. 1 is a side view of an embodiment of a packaging structure according to this application.
Figure 2:
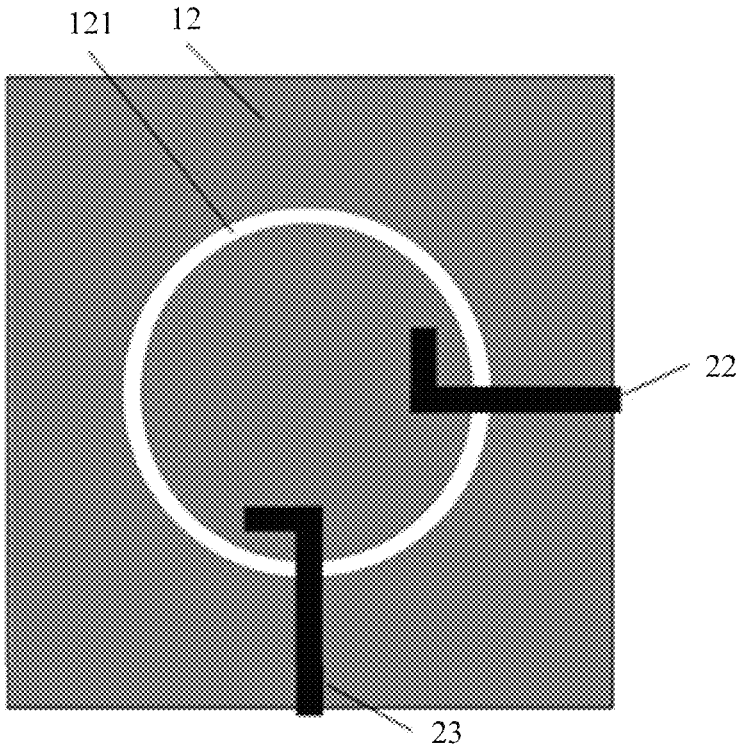
FIG. 2 is a bottom view of an embodiment of a packaging structure according to this application.
Figure 3:
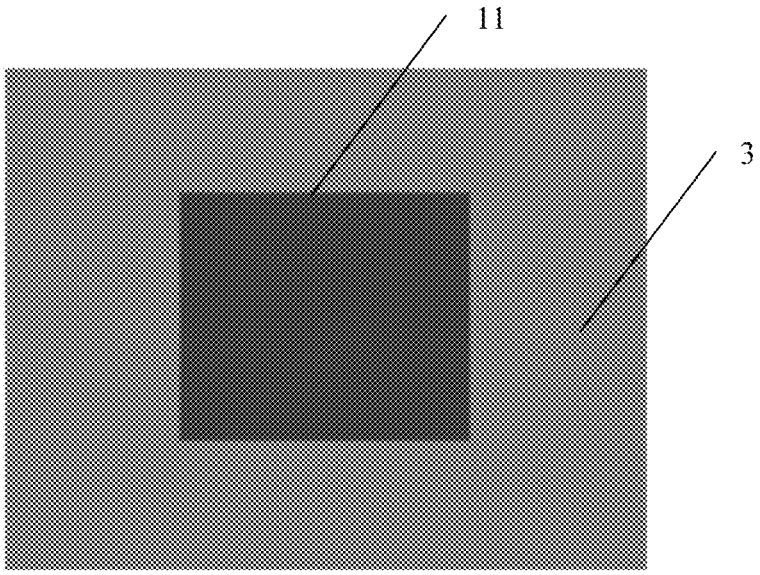
FIG. 3 is a top view of an embodiment of a packaging structure according to this application.

FIG. 1 is a side view of an embodiment of a packaging structure according to this application. FIG. 2 is a bottom view of an embodiment of a packaging structure according to this application. FIG. 3 is a top view of an embodiment of a packaging structure according to this application. As shown in FIG. 1 to FIG. 3, the packaging structure in this embodiment includes: a first radiation plate 11, a second radiation plate 12, and a feeding part 2, where the second radiation plate 12 is disposed below the first radiation plate 11, where a slot 121 is disposed on the second radiation plate 12, where the slot 121 is in a ring shape, and where the feeding part 2 is disposed below the second radiation plate 12.

The feeding part 2 includes a first feeding stub 22 and a second feeding stub 23 that are disposed independently of each other, where the first feeding stub 22 and the second feeding stub 23 are perpendicular to each other and disposed on a substrate below the slot 121, and where the first feeding stub 22 and the second feeding stub 23 feed the first radiation plate 11 using the slot 121.

Optionally, the feeding part 2 further includes a first signal line 24 and a second signal line 25, where the first signal line 24 or the second signal line 25 is configured to transmit a radio frequency signal.

Optionally, a shape of the slot 121 may be a ring shape. Optionally, the shape of the slot may be a circular ring, an elliptical ring, or a rectangular ring, and may alternatively be a star ring. This is not limited in this embodiment. A radius, a diameter, or a circumference of an area surrounded by the slot 121 may be obtained by testing based on a frequency that needs to be reached by an antenna. Generally, different frequencies correspond to different radiuses, diameters, or circumferences.

In this embodiment of this application, the first signal line 24 is connected to a signal transmit end of a radio frequency circuit, a signal receive end of a radio frequency circuit, or the like, and is configured to transmit a radio frequency signal. In this embodiment of this application, the first feeding stub 22 includes two segments: a main body and a tail end. The segment that is of the first feeding stub 22 and that is connected to the first signal line 24 is referred to as the main body. The main body of the first feeding stub 22 extends on a substrate on which the first feeding stub 22 is located. One end of the main body of the first feeding stub 22 is connected to the first signal line 24, and the other end of the main body is connected to the tail end. The tail end is bent relative to the main body, such that the first feeding stub 22 is folded as a whole to form an angle less than 180 degrees. The angle formed when the first feeding stub 22 is folded as a whole and lengths of the main body and the tail end may be adjusted based on a signal condition. Optionally, the angle formed by folding is 90 degrees, and the length of the tail end may be, for example, 1/10 or 1/8 of a total length of the first feeding stub 22.

The second signal line 25 is connected to a signal transmit end of a radio frequency circuit, a signal receive end of a radio frequency circuit, or the like, and is configured to transmit a radio frequency signal. In this embodiment of this application, the second feeding stub 23 includes two segments: a main body and a tail end. The segment that is of the second feeding stub 23 and that is connected to the second signal line 25 is referred to as the main body. The main body of the second feeding stub 23 extends on a substrate on which the second feeding stub 23 is located. One end of the main body is connected to the second signal line 25, and the other end of the main body of the second feeding stub 23 is connected to the tail end. The tail end is bent relative to the main body, such that the second feeding stub 23 is folded as a whole to form an angle less than 180 degrees. The angle formed when the second feeding stub 23 is folded as a whole and lengths of the main body and the tail end may be adjusted based on a signal condition. Optionally, the angle formed by folding is 90 degrees, and the length of the tail end may be, for example, 1/10 or 1/8 of a total length of the second feeding stub 23.

Referring to FIG. 2, a main body part of the first feeding stub 22 and a main body part of the second feeding stub 23 are perpendicular to each other. In addition, at least a part of the tail end of the first feeding stub 22 is located in a projection below the slot 121, that is, at least a part of the tail end of the first feeding stub 22 is located in a projection of the slot 121 on the substrate on which the first feeding stub is located. Additionally, at least a part of the tail end of the second feeding stub 23 is also located in a projection below the slot 121, that is, at least a part of the tail end of the second feeding stub 23 is located in a projection of the slot 121 on the substrate on which the second feeding stub is located.

Optionally, the angle formed when the first feeding stub 22 is folded as a whole and the angle formed when the second feeding stub 23 is folded as a whole may be the same or different. Additionally, the angles formed when the two feeding stubs are folded as a whole need to ensure that the first feeding stub 22 and the second feeding stub 23 are independent of each other and do not intersect. The length of the tail end of the first feeding stub 22 and the length of the tail end of the second feeding stub 23 may be the same or different.

The first folded feeding stub 22 and the second folded feeding stub 23 are perpendicular to each other and disposed on the substrate below the slot 121. Optionally, the first folded feeding stub 22 and the second folded feeding stub 23 may be disposed on a same layer of substrate. When the first folded feeding stub 22 and the second folded feeding stub 23 are disposed on the same layer of substrate, an effect of polarization isolation is comparatively good. Alternatively, the first folded feeding stub 22 and the second folded feeding stub 23 may be disposed on different layers of substrates. In this case, two substrates may be disposed up and down in the feeding part 2. Regardless of one substrate or two substrates, a through-hole is disposed on the substrate for the first signal line 24 and the second signal line 25 to pass through.

Figure 4:
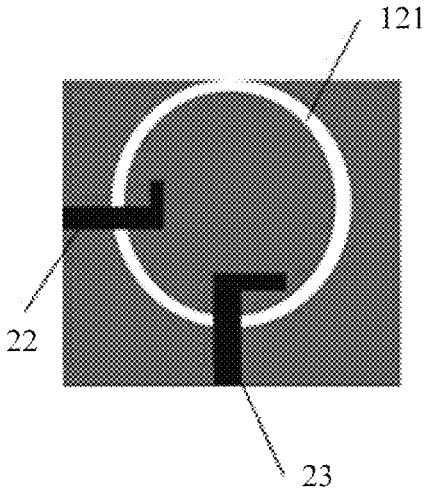
FIG. 4 is a bottom view of a feeding part in an embodiment of a packaging structure.

FIG. 4 is a bottom view of a feeding part and a slot in an embodiment of a packaging structure. As shown in FIG. 4, the slot 121 is in a circular ring shape, a part of the tail end of the first feeding stub 22 is located in a projection of the slot 121 on the substrate on which the first feeding stub 22 is located, and a part of the tail end of the second feeding stub 23 is located in a projection of the slot 121 on the substrate on which the second feeding stub 23 is located.

Figure 6:
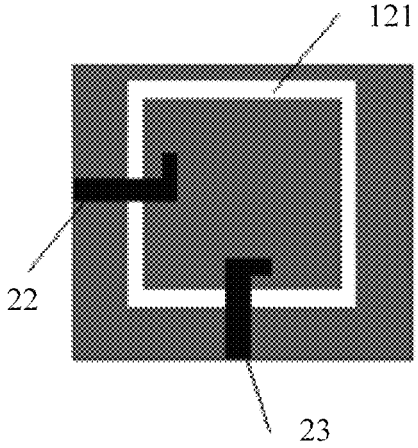
FIG. 6 is a bottom view of a feeding part in an embodiment of a packaging structure.

FIG. 6 is a bottom view of a feeding part in an embodiment of a packaging structure. As shown in FIG. 6, the slot 121 is in a rectangular ring shape, which may be a rectangular ring, or may be a square ring. A part of the tail end of the first feeding stub 22 is located in a projection of the slot 121 on the substrate on which the first feeding stub 22 is located, and a part of the tail end of the second feeding stub 23 is located in a projection of the slot 121 on the substrate on which the second feeding stub 23 is located.

Figure 7:
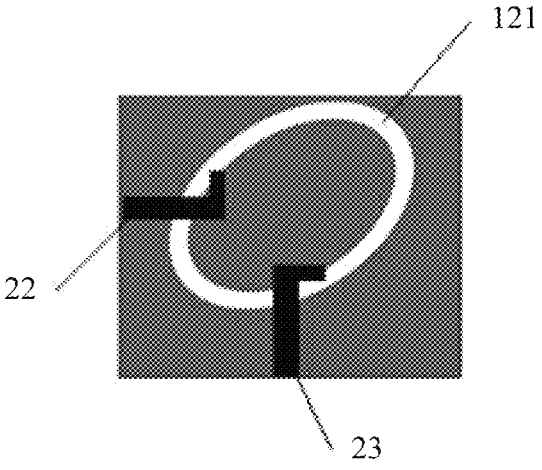
FIG. 7 is a bottom view of a feeding part in an embodiment of a packaging structure.

FIG. 7 is a bottom view of a feeding part in an embodiment of a packaging structure. As shown in FIG. 7, the slot 121 is in an elliptical ring shape, a part of the tail end of the first feeding stub 22 is located in a projection of the slot 121 on the substrate on which the first feeding stub 22 is located, and a part of the tail end of the second feeding stub 23 is located in a projection of the slot 121 on the substrate on which the second feeding stub 23 is located.

In the foregoing embodiment of this application, the two feeding stubs are disposed on the substrate below the slot 121, and a vertical spacing between the two feeding stubs and the second radiation plate 12 may be set based on measurement of experimental data of a bandwidth that is to be implemented.

In the foregoing embodiment of this application, the first feeding stub 22 and the second feeding stub 23 perform coupling feeding on the first radiation plate 11 by being electromagnetically coupled to the slot 121, to transmit an electromagnetic wave signal.

Figure 8:
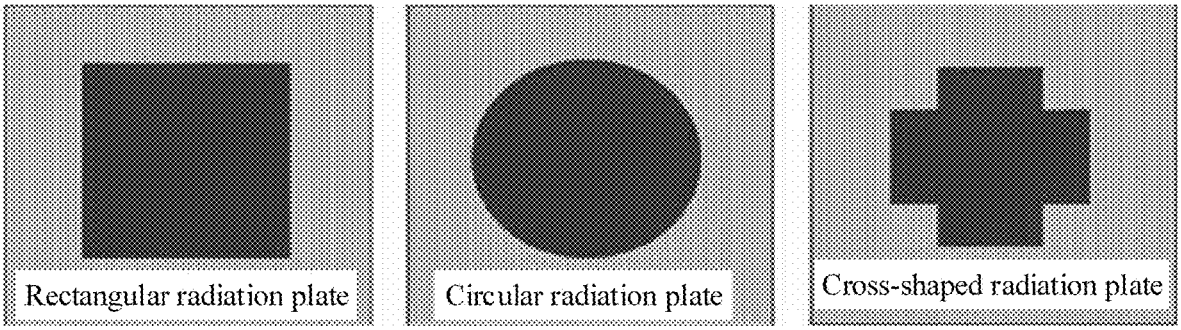
FIG. 8 is a top view of a first radiation plate.

As shown in FIG. 3, the first radiation plate 11 is disposed above a top-layer substrate 3. FIG. 8 is a top view of the first radiation plate. As shown in FIG. 8, optionally, a shape of the first radiation plate 11 may be a rectangle, a circle, or a cross. In this embodiment, a size (an area) of the first radiation plate 11 may be set based on performance that needs to be achieved by an antenna.

Optionally, the first radiation plate 11 is a parasitic patch, and a shape of the parasitic patch may be a rectangle, a circle, or a cross.

Figure 9:
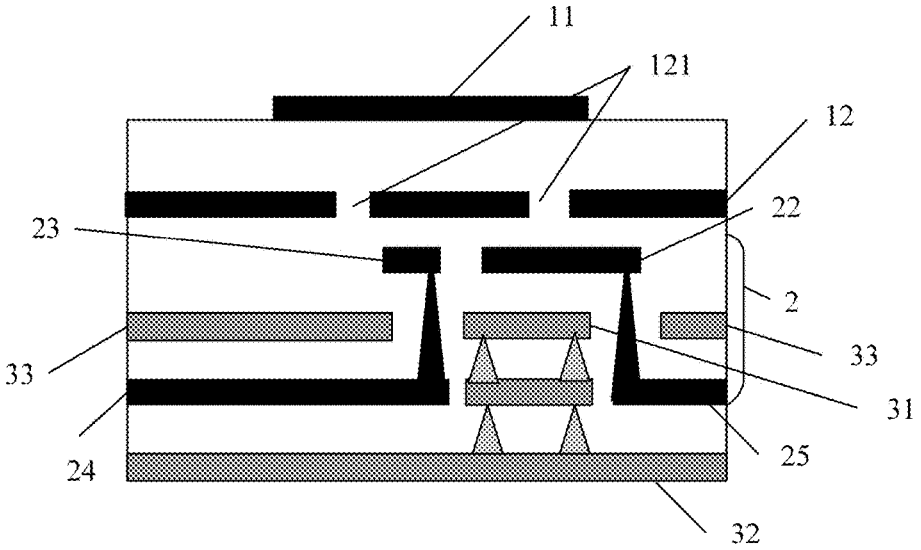
FIG. 9 is a side view of an embodiment of a packaging structure according to this application.

FIG. 9 is a side view of an embodiment of a packaging structure according to this application. As shown in FIG. 9, the packaging structure in this embodiment may further include a first ground plate 31 that is disposed between the first signal line 24 and the second signal line 25, where the first ground plate 31 is configured to implement isolation between the signal lines and shield interference between the signal lines. The first ground plate 31 may be made of a metallic material. In this embodiment of this application, two layers of first ground plates 31 are disposed between the first signal line 24 and the second signal line 25. In practice, a quantity of layers of the first ground plate 31 may be increased or decreased based on lengths of the first signal line and the second signal line on a vertical plane. In a scenario in which there is a plurality of layers of first ground plates 31, the plurality of layers of the first ground plates 31 may be connected using through-holes plated with metal or filled with metal. These through-holes plated with metal or filled with metal can further improve a shielding effect. In an optional embodiment, a plurality of groups of dual-polarized antennas may be packaged together, for example, packaged at a bottom of a chip. Therefore, a third ground plate 33 may also be disposed on two sides of the first signal line 24 and the second signal line 25, as shown in FIG. 9, to isolate interference between different signal lines.

Optionally, as shown in FIG. 9, the dual-polarized antenna in this embodiment may further include a second ground plate 32 that is disposed at a bottom of the feeding part 2. The dual-polarized antenna provided in this application is a packaged antenna. The dual-polarized antenna is usually packaged, using a packaging process, together with a chip configured to process data. Considering performance of receiving and transmitting a radio frequency signal by the antenna, the antenna is usually packaged on a surface of the chip. However, this also brings a problem that a signal received or transmitted by the antenna causes interference to various functional components in the chip. In this case, the second ground plate 32 disposed at the bottom of the feeding part may be configured to implement signal interference between the antenna and the chip. The first signal line 24 and the second signal line 25 may pass through or bypass the second ground plate 32 in various manners. For example, a through-hole plated with metal or filled with metal is disposed on the second ground plate 32, or the first signal line 24 and the second signal line 25 are communicatively connected to the chip using a pin on an antenna side in a wired bonding manner. Even if the antenna is not packaged on the surface of the chip, but is instead disposed side by side with the chip on a carrier board, the second ground plate 32 disposed at a bottom of the antenna can also isolate signal interference between the antenna and various signal lines on the carrier board below the antenna.

Optionally, the packaging structure in this embodiment further includes a substrate and a chip that is fixedly connected to a side of the substrate, where the chip has a plurality of feeding pins, the plurality of feeding pins are connected to the substrate, and the substrate includes the first radiation plate, the second radiation plate, and the feeding part. The chip may be located on a lower surface of the substrate, and the first radiation plate and the second radiation plate may be located on a side that is of the substrate and that is close to an upper surface.

In another embodiment, a dual-polarized antenna in package may be an independent packaging structure, and the packaging structure and a chip are designed to be side by side on a side of a substrate.

According to the packaging structure provided in this embodiment, by disposing the closed ring-shaped slot, the first radiation plate, and the second radiation plate, a bandwidth and a gain can be increased, thereby implementing a wide bandwidth and a high gain. Further, an operating bandwidth of an antenna is extended to a wider frequency band, and the antenna is applicable to a terminal operating on a wide frequency band, thereby expanding an application scope of the antenna. In addition, the slot is set to be in a closed ring shape, and the two feeding stubs are perpendicular to each other. In this case, electric fields corresponding to the two feeding stubs are orthogonal, and comparatively good isolation is achieved between electric fields generated by feeding by the two feeding stubs, thereby implementing comparatively high polarization isolation.

The following uses an example to describe in detail the technical solutions of the foregoing embodiment.

Figure 10:
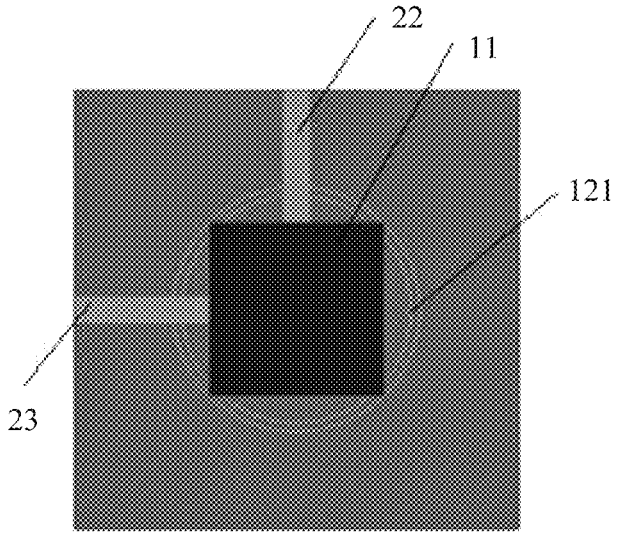
FIG. 10 is a top view of an embodiment of a packaging structure according to this application.
Figure 11:
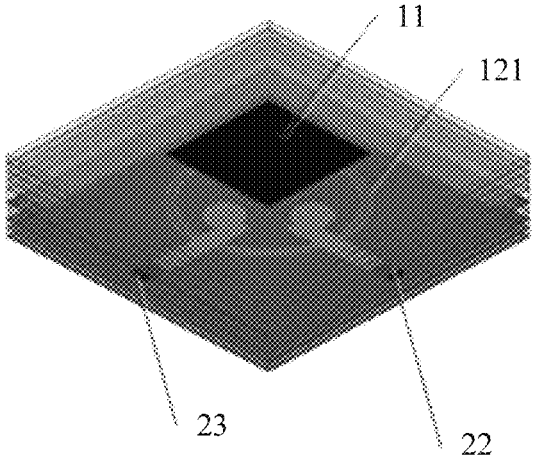
FIG. 11 is a side view of an embodiment of a packaging structure according to this application.
Figure 12:
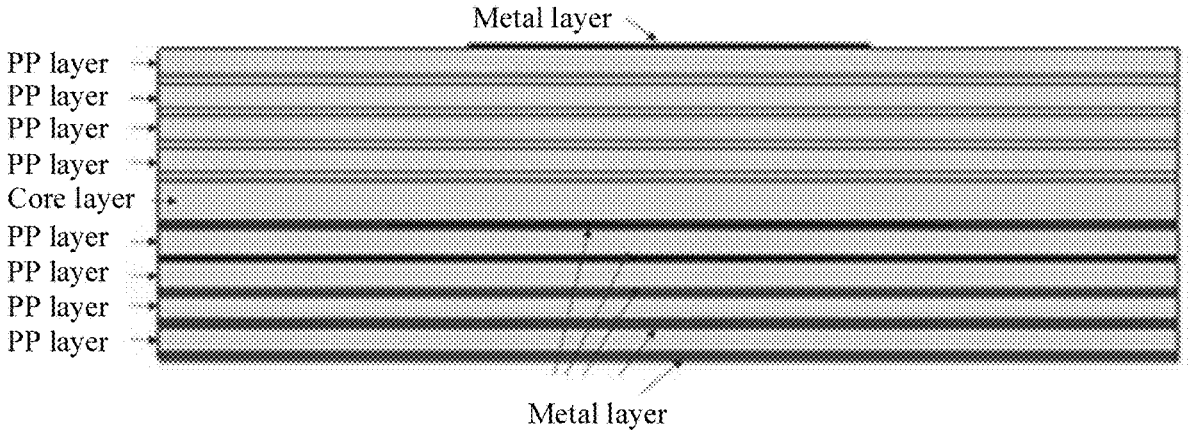
FIG. 12 is a schematic diagram of distribution of a prepreg (PP) layer, a core layer, and a metal layer in a packaging structure according to this application.

FIG. 10 is a top view of an embodiment of a packaging structure according to this application. FIG. 11 is a side view of an embodiment of a packaging structure according to this application. As shown in FIG. 10 and FIG. 11, in the packaging structure in this embodiment, a first radiation plate 11, a second radiation plate 12 and a feeding part are implemented on ten layers of substrates. In this embodiment, a shape of the first radiation plate 11 is a rectangle. FIG. 12 is a schematic diagram of distribution of a prepreg (PP) layer, a core layer, and a metal layer in a packaging structure according to this application. In this embodiment, a thickness of the PP layer is 60 micrometers (um), a thickness of the core layer is 100 um, and a thickness of the metal layer is 15 um. In this embodiment, the second radiation plate 12 is disposed below the first radiation plate 11; a slot 121 is disposed on the second radiation plate 12, where the slot 121 is in a closed ring shape; the feeding part 2 is disposed below the second radiation plate 12; the feeding part 2 includes a first feeding stub 22 and a second feeding stub 23 that are disposed independently of each other, a first signal line 24, and a second signal line 25; and the first feeding stub 22 and the second feeding stub 23 are perpendicular to each other and disposed on a same layer of substrate below the slot. The slot 121 in this embodiment is in a circular ring shape. The first feeding stub 22 and the second feeding stub 23 perform coupling feeding on the first radiation plate by being electromagnetically coupled to the slot 121. The first feeding stub 22 and the second feeding stub 23 shown in FIG. 10 are perpendicular to each other. Both the first feeding stub 22 and the second feeding stub 23 are folded at an angle of 90 degrees, and both folded lengths are, for example, 1/10 of a total length of the feeding stub. A part of a tail end of the first feeding stub 22 is located in a projection of the slot 121 on a substrate on which the first feeding stub 22 is located. A part of a tail end of the second feeding stub 23 is located in a projection of the slot 121 on a substrate on which the second feeding stub 23 is located.

In this embodiment, by disposing the ring-shaped slot, the first radiation plate, and the second radiation plate, a bandwidth and a gain can be increased, thereby implementing a wide bandwidth and a high gain. Further, an operating bandwidth of an antenna is extended to a wider frequency band, and the antenna is applicable to a terminal operating on a wide frequency band, thus expanding an application scope of the antenna. In addition, the slot is set to be in a ring shape, and the two feeding stubs are perpendicular to each other. In this case, electric fields corresponding to the two feeding stubs are orthogonal, and comparatively good isolation is achieved between electric fields generated by feeding by the two feeding stubs, thereby implementing comparatively high polarization isolation. Comparatively good antenna performance (including a wide bandwidth, a high gain, and comparatively high polarization isolation) may be achieved through emulation. The following describes performance of the packaging structure in the embodiment shown in FIG. 10 and FIG. 11 with reference to emulation results shown in FIG. 13 to FIG. 15.

Figure 13:
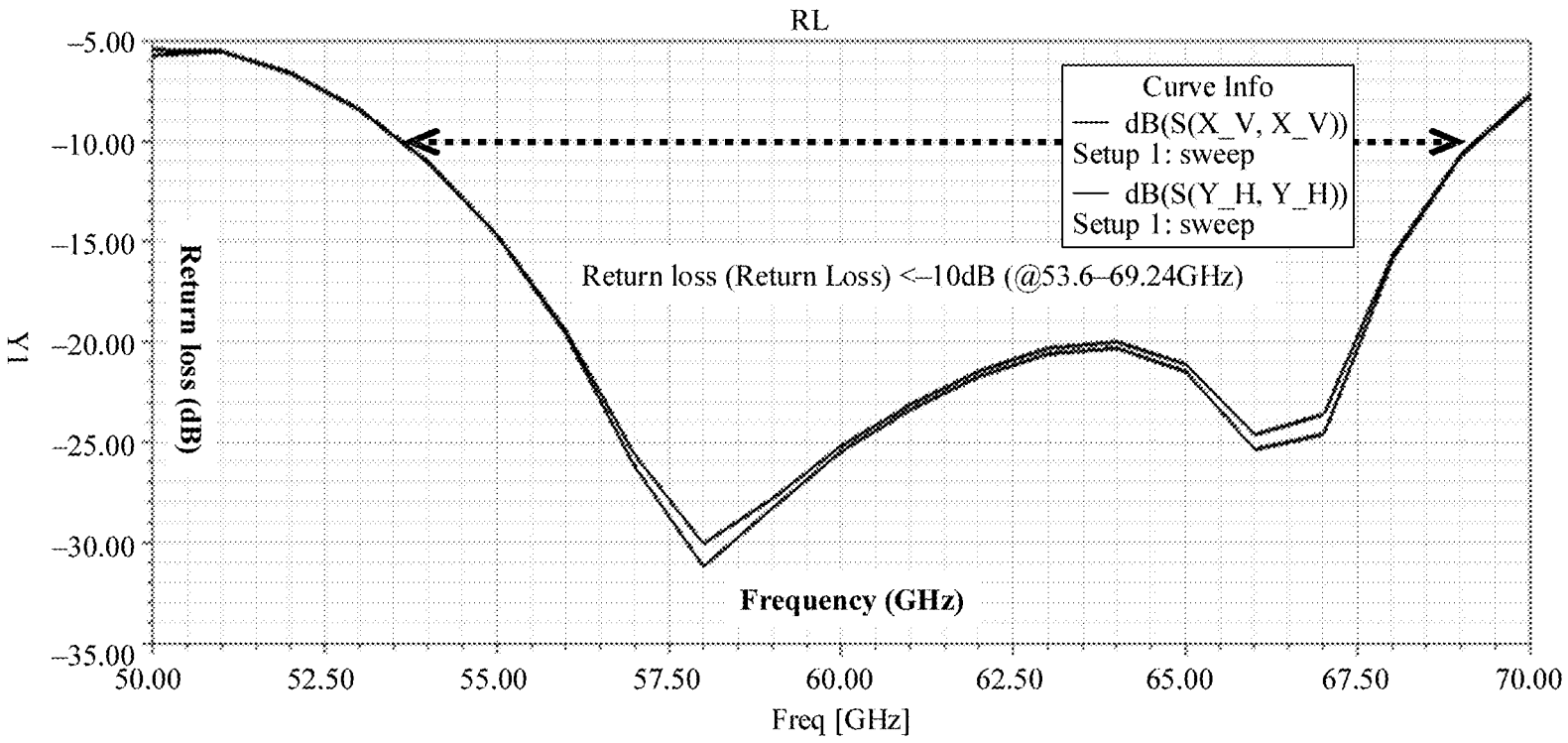
FIG. 13 is a schematic diagram of an emulation result of a return loss of a packaging structure.

FIG. 13 is a schematic diagram of an emulation result of a return loss (RL) of a packaging structure. As shown in FIG. 13, a horizontal coordinate indicates a frequency, a vertical coordinate indicates a return loss, a frequency range with a return loss less than −10 decibels (dB) is between 53.6 gigahertz (GHz) and 69.24 GHz, and for the return losses less than −10 dB, a displayed bandwidth reaches 15.3 GHz, which is up to a bandwidth percentage of 25.5% (calculated based on a center frequency of 60 GHz). It can be learned that the packaging structure in this embodiment can reach a comparatively wide bandwidth.

Figure 14:
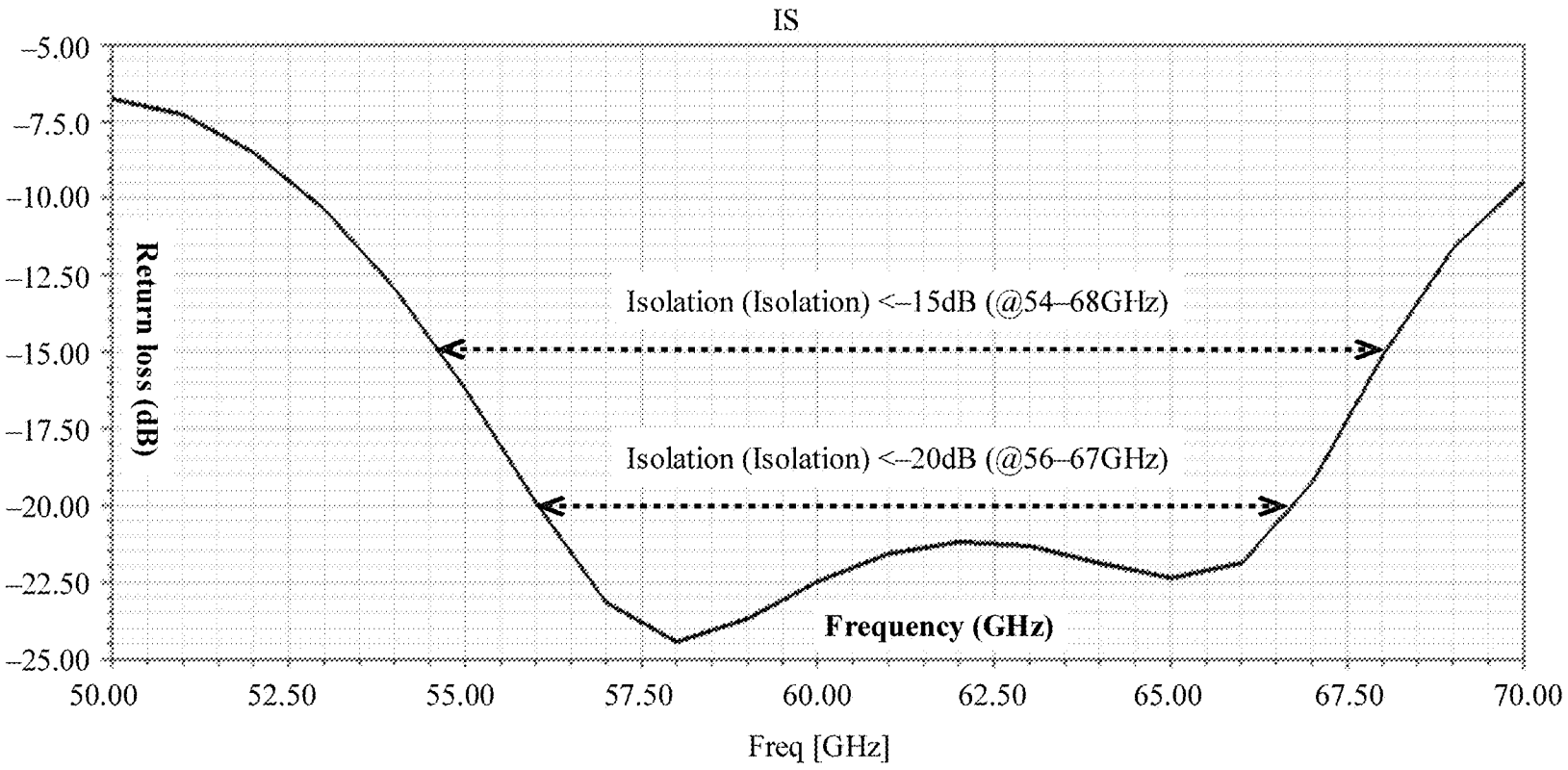
FIG. 14 is a schematic diagram of an emulation result of polarization isolation of a packaging structure.

FIG. 14 is a schematic diagram of an emulation result of polarization isolation of a packaging structure. As shown in FIG. 14, a horizontal coordinate indicates a frequency, a vertical coordinate indicates isolation, a frequency range with isolation less than −15 dB is between 54 GHz and 68 GHz, and a frequency range with isolation less than −20 dB is between 56 GHz and 67 GHz. It can be learned that the packaging structure in this embodiment implements comparatively high polarization isolation.

Figure 15:
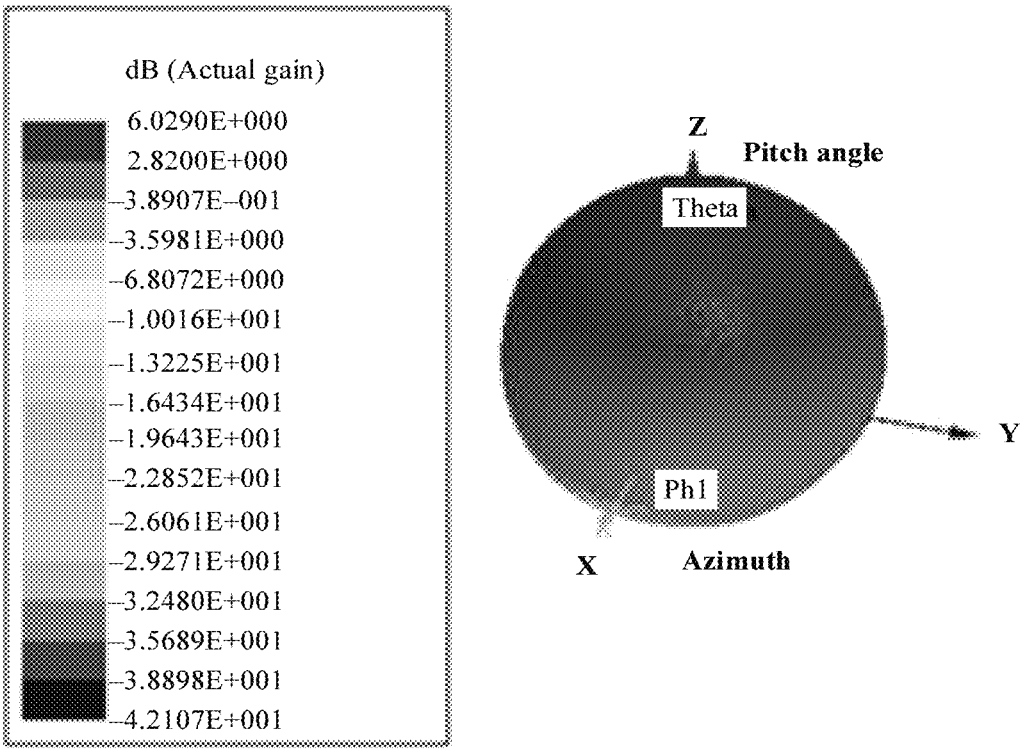
FIG. 15 is a three-dimensional (3D) radiation pattern of a packaging structure.

FIG. 15 is a 3D radiation pattern of a packaging structure. It can be learned from the 3D radiation pattern that an antenna gain reaches 6.029 decibel relative to isotrope (dBi), the gain is high, and radiation is wide. In terms of a radiation pattern, each section is comparatively balanced. This greatly facilitates subsequent array integration. It can be learned that the packaging structure in this embodiment achieves a comparatively high gain.

Figure 5:
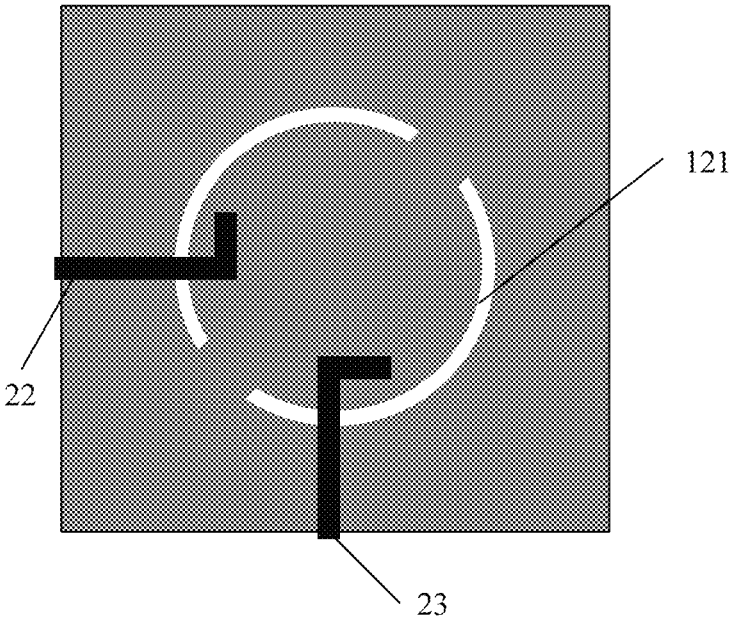
FIG. 5 is a bottom view of a feeding part in an embodiment of a packaging structure.

In addition, it should be noted that the slots in the embodiments in FIG. 4, FIG. 6, and FIG. 7 of this application are all closed rings, for example, a complete ring, a complete elliptical ring, and a complete rectangular ring. However, in an actual product, the slot on the second radiation plate may alternatively be an unclosed ring, that is, the ring-shaped slot does not extend continuously. FIG. 5 is a bottom view of a feeding part in an embodiment of a packaging structure. For example, as shown in FIG. 5, a slot 121 is in a circular ring shape, but the slot 121 is not continuous as a whole, and is formed by two parts of arcs on a second radiation plate. The two parts of arcs are separated in between by a part of a structure of the second radiation plate, but are spliced as a whole to form the slot in the circular ring shape.

Performance effects achieved by the packaging structure in this embodiment of this application bring a quite large engineering margin. In addition, a processing period for a small quantity of stacked layers of substrates is very short and the process is mature. After being synchronously processed, the substrates are packaged in a unified manner, which can greatly reduce the processing period and processing costs. Compared with other approaches, manufacturing process time is shortened, costs can be reduced, and a performance margin is large. Therefore, a product yield rate is easy to achieve, and the packaging structure is more suitable for mass production when being applied to an antenna array.

Figure 16:
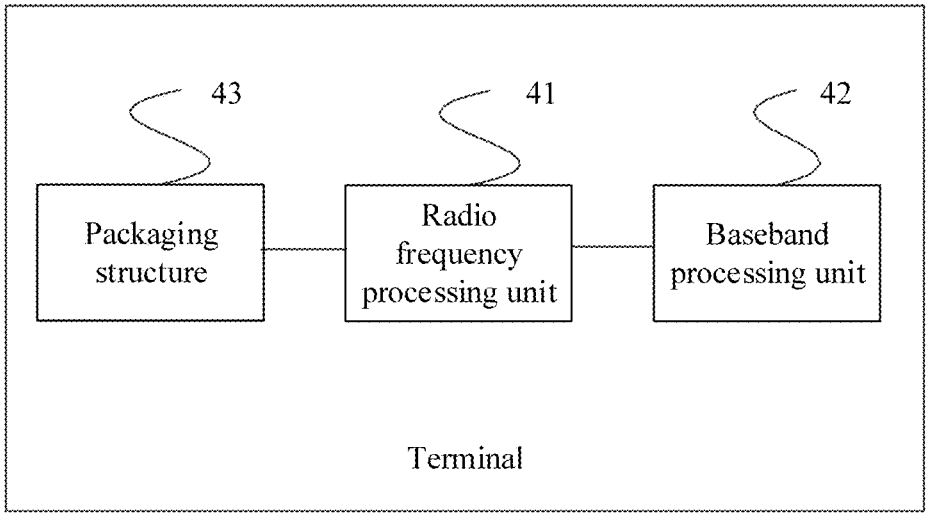
FIG. 16 is a schematic structural diagram of an embodiment of a terminal according to this application.

FIG. 16 is a schematic structural diagram of an embodiment of a terminal according to this application. As shown in FIG. 16, the terminal in this embodiment may include a radio frequency processing unit 41, a baseband processing unit 42, and a packaging structure 43.

For a structure of the packaging structure 43, reference may be made to the description in the foregoing embodiments, and details are not described herein again.

The terminal provided in this embodiment may be a communications terminal such as a data card, a wireless network card, a wireless router, a mobile phone, a wearable device, glasses, or a media apparatus.

The foregoing implementations, schematic structural diagrams, or schematic emulation diagrams are merely examples for describing the technical solutions of this application. Size proportions and emulation values thereof do not constitute a limitation on the protection scope of the technical solutions. Any modification, equivalent replacement, or improvement made without departing from the spirit and principle of the foregoing implementations shall fall within the protection scope of the technical solutions.

What is claimed is:

1. A packaging structure, comprising:

a first radiation plate;

a second radiation plate disposed below the first radiation plate and comprising a slot, wherein the slot is in a ring shape;

a feeding part disposed below the second radiation plate, wherein the feeding part comprises a first signal line, a second signal line, a first feeding stub and a second feeding stub, and wherein the first feeding stub and the second feeding stub are disposed independently of each other;

a substrate on which the first feeding stub and the second feeding stub are disposed, wherein the first feeding stub and the second feeding stub are perpendicular to each other and disposed on the substrate below the slot; and a first ground plate that is disposed between the first signal line and the second signal line, wherein the first feeding stub and the second feeding stub are configured to feed the first radiation plate using the slot.

2. The packaging structure according to claim 1, wherein the first feeding stub is L-shaped and comprises a first main body and a first tail end, wherein the first tail end is bent relative to the first main body to form an L shape, wherein the first main body extends on a first substrate on which the first feeding stub is located, wherein one end of the first main body is connected to the first signal line, and wherein another end of the first main body is connected to the first tail end.

3. The packaging structure according to claim 2, wherein the second feeding stub comprises a second main body and a second tail end, wherein the second tail end is bent relative to the second main body, wherein the second main body extends on a second substrate on which the second feeding stub is located, wherein one end of the second main body is connected to the second signal line, and wherein another end of the second main body is connected to the second tail end.

4. The packaging structure according to claim 3, wherein at least a part of the first tail end is located in a first projection below the slot, and wherein at least a part of the second tail end is located in a second projection below the slot.

5. The packaging structure according to claim 1, wherein the first feeding stub and the second feeding stub are disposed on a same layer of the substrate.

6. The packaging structure according to claim 1, wherein an inner side of the slot is defined by a first portion of the second radiation plate, wherein an outer side of the slot is defined by a second portion of the second radiation plate, and wherein the first portion and the second portion are separated by the slot.

7. The packaging structure according to claim 1, wherein a shape of the slot is a circular ring.

8. The packaging structure according to claim 1, wherein a shape of the slot is an elliptical ring.

9. The packaging structure according to claim 1, wherein a shape of the slot is a rectangular ring.

10. The packaging structure according to claim 1, wherein a shape of the slot is a star ring.

11. The packaging structure according to claim 1, wherein a shape of the first radiation plate is a rectangle.

12. The packaging structure according to claim 1, wherein a shape of the first radiation plate is a circle.

13. The packaging structure according to claim 1, wherein a shape of the first radiation plate is a cross.

14. The packaging structure according to claim 1, wherein the first radiation plate is a parasitic patch.

15. The packaging structure according to claim 1, wherein the packaging structure further comprises a second ground plate that is disposed at a bottom of the feeding part.

16. The packaging structure according to claim 1, wherein the packaging structure further comprises a second substrate.

17. The packaging structure according to claim 16, wherein the second substrate comprises the first radiation plate, the second radiation plate, and the feeding part.

18. The packaging structure according to claim 1, wherein the slot comprises a first arc portion and a second arc portion.

19. The packaging structure according to claim 18, wherein the first arc portion and the second arc portion are separated from each other.

20. The packaging structure according to claim 19, wherein the first arc portion and the second arc portion are separated from each other by a part of a structure of the second radiation plate.

* * * * *